US010617966B1

(12) United States Patent
Pena

(10) Patent No.: US 10,617,966 B1
(45) Date of Patent: Apr. 14, 2020

(54) CLACKING BALL TOY

(71) Applicant: Daniel Pena, Stokesdale, NC (US)

(72) Inventor: Daniel Pena, Stokesdale, NC (US)

( * ) Notice: Subject to any disclaimer, the term of this patent is extended or adjusted under 35 U.S.C. 154(b) by 0 days.

(21) Appl. No.: 16/202,267

(22) Filed: Nov. 28, 2018

(51) Int. Cl.
*A63H 31/00* (2006.01)
*A63H 33/00* (2006.01)

(52) U.S. Cl.
CPC ..... *A63H 31/00* (2013.01); *A63H 33/00* (2013.01)

(58) Field of Classification Search
CPC ..... A63H 33/00; A63H 1/00
See application file for complete search history.

(56) References Cited

U.S. PATENT DOCUMENTS 1,858,145 A * 5/1932 Felardo ..... A63H 33/22 446/266
3,254,444 A * 6/1966 Paterson ..... A63H 33/00 2/209.13
7,445,585 B2 * 11/2008 Domenge ..... A63B 21/06 482/110
9,707,472 B2 * 7/2017 Glass ..... A63F 7/40
2001/0046829 A1 * 11/2001 Chung ..... A63H 3/20 446/353
2012/0214380 A1 * 8/2012 Vine, III ..... A44C 5/0084 446/121
2012/0220188 A1 * 8/2012 Noe' ..... A63B 21/0608 446/421

* cited by examiner

*Primary Examiner* — Melba Bumgarner
*Assistant Examiner* — Amir A Klayman
(74) *Attorney, Agent, or Firm* — Tuggle Duggins P.A.; Blake P. Hurt

(57) ABSTRACT

A clacker ball toy having a housing, a handle attached to the housing, a pair of rods pivotally mounted to the housing, and a sphere attached to an end of each rod at a location remote from the housing, wherein the rods are operatively interconnected to one another so as to move together and in unison with one another, the rods and spheres being mounted such that they can move in a circumferential arc relative to the housing and also move in a common plane, whereby the spheres will strike each other at apex points within the common plane above and below the housing. In the embodiments, the spheres contain an LED device which will illuminate during use of the toy.

9 Claims, 8 Drawing Sheets

CLACKING BALL TOY

FIELD OF THE INVENTION

The invention herein pertains to a clacking ball toy, and more particularly pertains to a clacking ball toy with improved safety features that also generates electricity for illumination during use, with or without the need of batteries.

DESCRIPTION OF THE PRIOR ART AND OBJECTIVES OF THE INVENTION

During the late 1960's and 1970's, a particular children's toy was very popular in the marketplace. This toy, known and sold under various brand names such as "Clackers", Klick Klaks", "Ker Bangers", "Knockers", "Kbonger", "Ker-Knockers", "Whak-Ko's" and other names consisted of two spheres attached to opposite ends of a length of string. Mid-way between the spheres and attached to the string was a ring, rod or other grip element.

In use, a child would hold the ring/grip element and allow the spheres to hang. Using a gentle motion of the hand to start would cause the spheres to swing outward and then back to center in a pendulum motion. As the spheres reached the center, they would strike one another and then repel. By timing the motion of the hand with the swing of the spheres, the user could cause the spheres to swing in greater and greater arcs until they stuck one another both above and below the user's wrist. A prime objective of the toy was to gain sufficient proficiency as to maintain this continuous striking of the spheres for a significant length of time while also moving the plane of motion from a vertical plane to a horizontal and various planes in between.

The clacker type toy had some very positive attributes. For example, it illustrated Newton's Third Law of Motion: i.e., for every action, there is an equal and opposite reaction. It also promoted good hand/eye coordination, timing, and fine motor skills. Despite these attributes, the clacker type toy had some serious safety flaws. The risk of being struck by a hard sphere was always present from using the toy and was something that could be expected. Many a child playing with a clacker toy had bruises on the wrist and forearm while learning to master the toy. A hidden, and more serious safety issue with the clacker type toy was that the material used to make the spheres (acrylic) could not withstand the force of the spheres striking one another for prolonged periods of time. As a consequence, the spheres would eventually shatter, sending small pieces of hard plastic flying in every direction, causing serious injury. The clacker type toy was eventually banned for sale in the US in 1985, although vintage original versions are available on eBay.

Newer versions of the clacker type toy have surfaced and are available from various commercial outlets. For example, "Smackerz", available from Fat Brain Toys, consists of a handle attached to a mid-point on a string and two soft, air filled rubber spheres located on opposite ends of the string. The Smackerz toy is played in the same manner as the original toy, and is safer because it avoids both the risk of injury from a strike by the ball as well as the shattering sphere concerns. It does, however, lack the characteristic "clacking" sound of the original. Other versions of the original clacker toy are commercially available from outlets such as Amazon (called "Clacker Balls on a String"), Vermont Country Store (called "Quick Clacks"); TinToyArcade.com (called "Clackers Toy"). All of these have hard plastic spheres on a string, like the original versions. However, the plastic spheres in the new versions—unlike the original—are shatterproof. However, with these versions, because the spheres are hard and attached to string, there is a potential for injury from being struck by one or both of the moving spheres. Finally, none of these toys were appropriate for use in the dark, an operating environment experimented with by numerous children over the years.

There is a need to further improve upon the clacker type toy by incorporating additional safety and entertainment features.

Thus, in view of the problems and disadvantages associated with prior art devices, the present invention was conceived and one of its objectives is to provide a safer and more entertaining version of the clacker type toy.

It is another objective of the present invention to provide an improved clacker type toy that used spheres attached to relatively rigid rods instead of string, thus reducing the potential for injury from a moving sphere.

It is a further object of the invention to provide an improved clacker type toy that incorporates LED illumination in the balls.

Various other objectives and advantages of the present invention will become apparent to those skilled in the art as a more detailed description is set forth below.

SUMMARY OF THE INVENTION

The aforesaid and other objectives are realized by providing a clacker ball toy having a housing, a handle attached to the housing, a pair of rods pivotally mounted to the housing, and a sphere attached to an end of each rod at a location remote from the housing. The rods are operatively interconnected to one another so as to move together as the toy is in use. The rods and spheres are mounted such that they can move in an arcuate path relative to the housing and also move in a common plane, whereby the spheres will strike each other at apex points within the common plane above and below the housing, without deviation from the path in the direction of the user. In the embodiments, the spheres contain an LED device which will illuminate during use of the toy.

DETAILED DESCRIPTION OF THE PREFERRED EMBODIMENT AND OPERATION OF THE INVENTION

Figure 1:
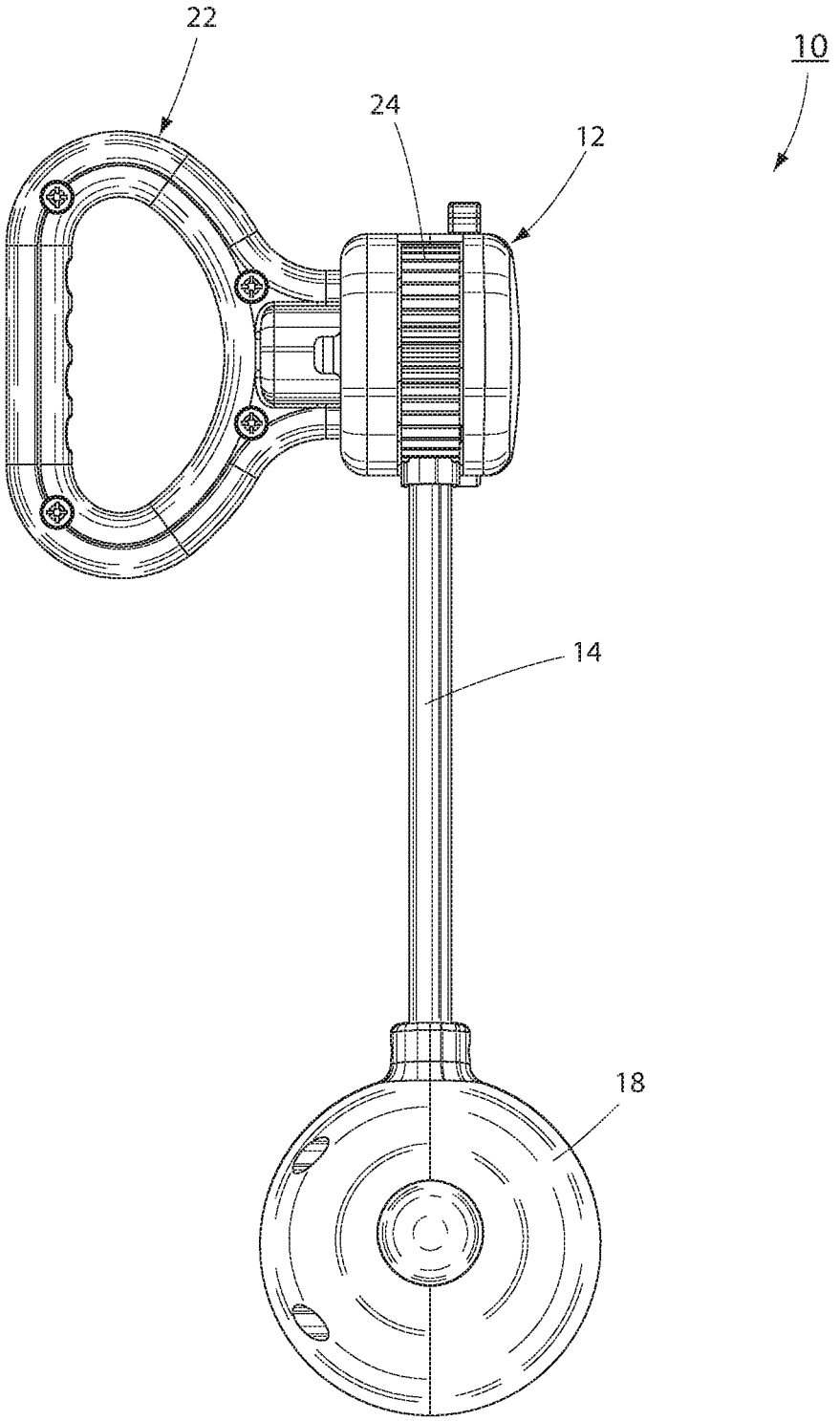
FIG. 1 is a side elevation view of the clacking ball toy according to an embodiment of the invention.
Figure 2:
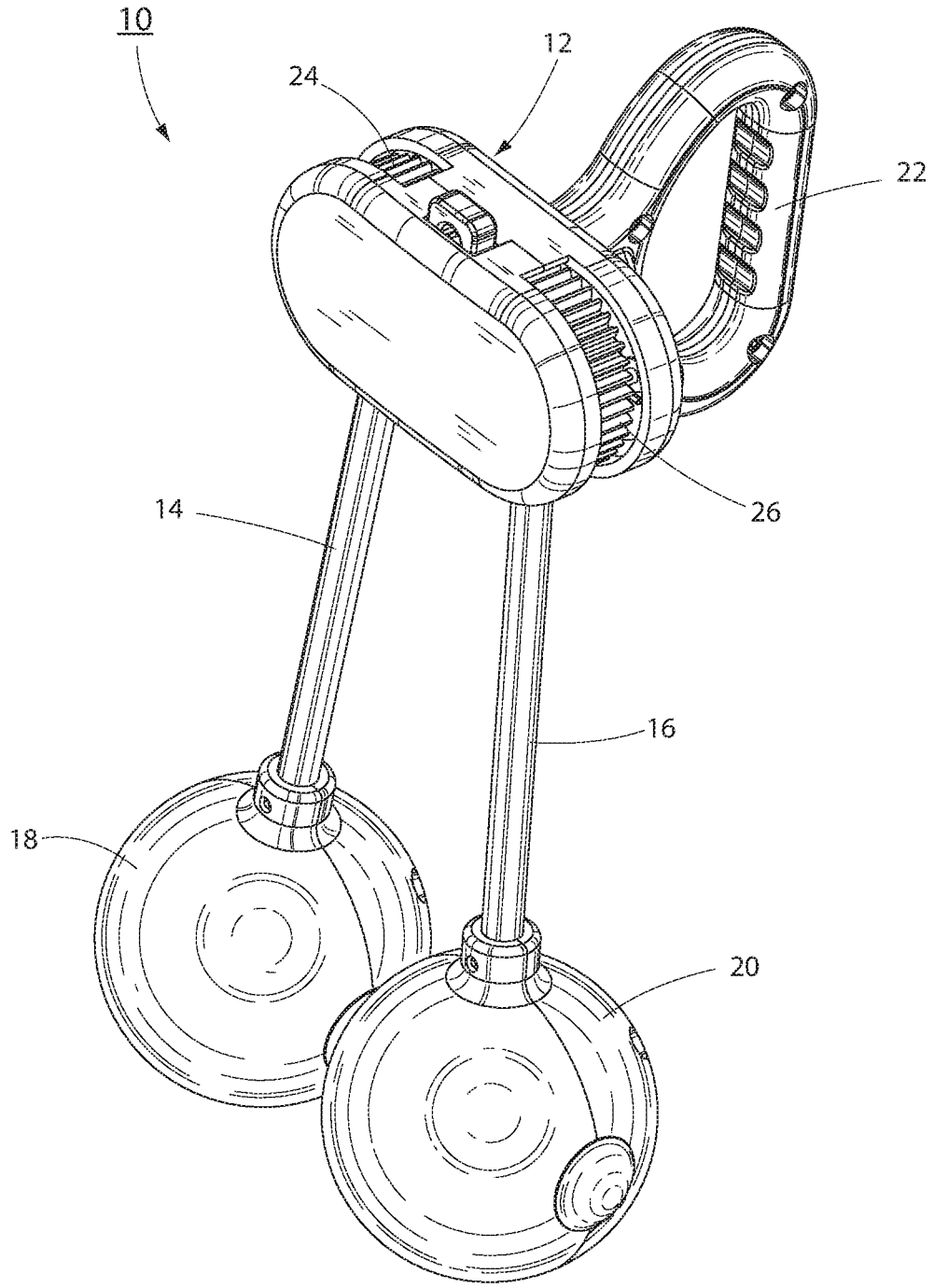
FIG. 2 is a front perspective view of the embodiment of FIG. 1.
Figure 3:
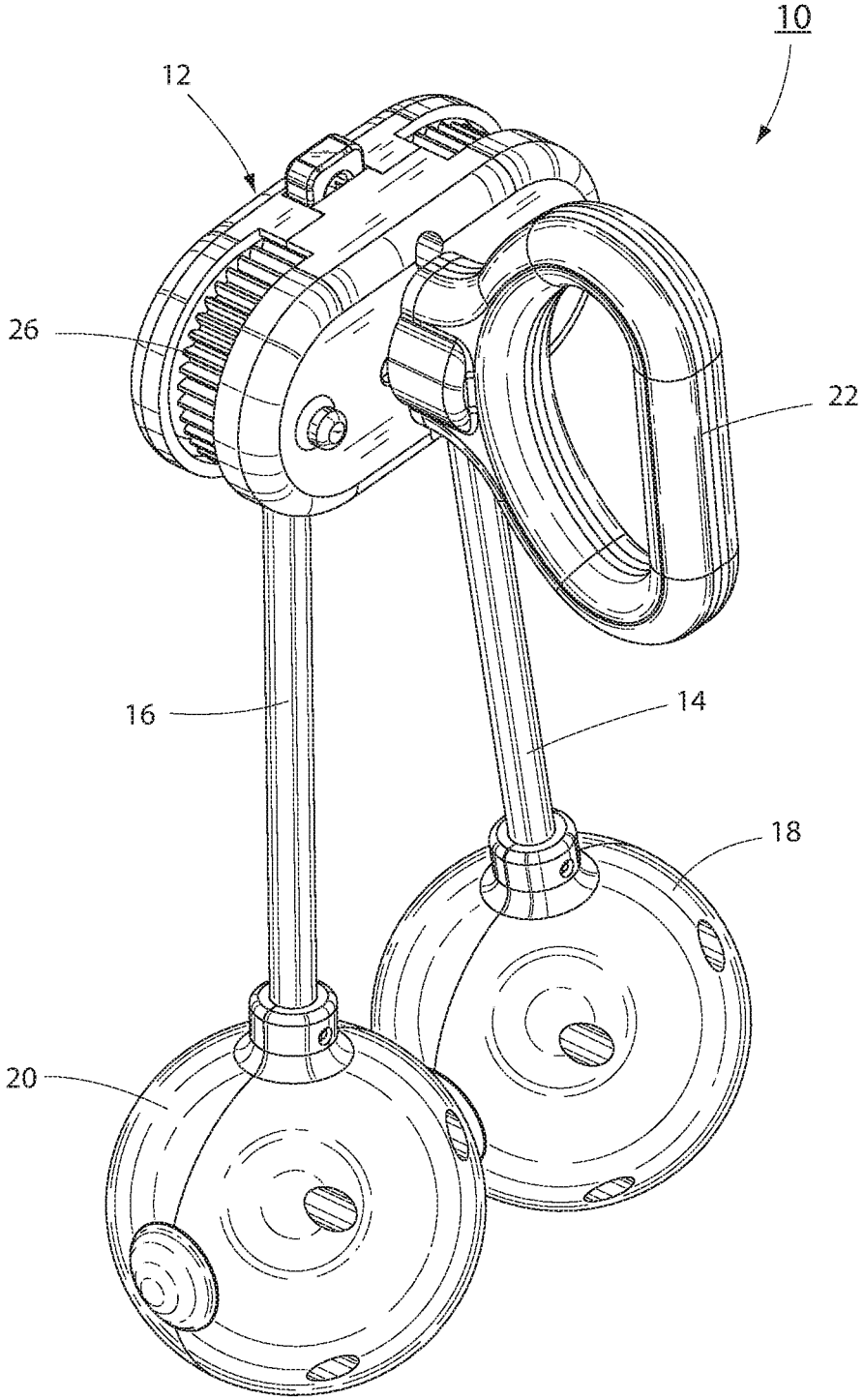
FIG. 3 is a rear perspective view of the embodiment of FIG. 1.
Figure 4:
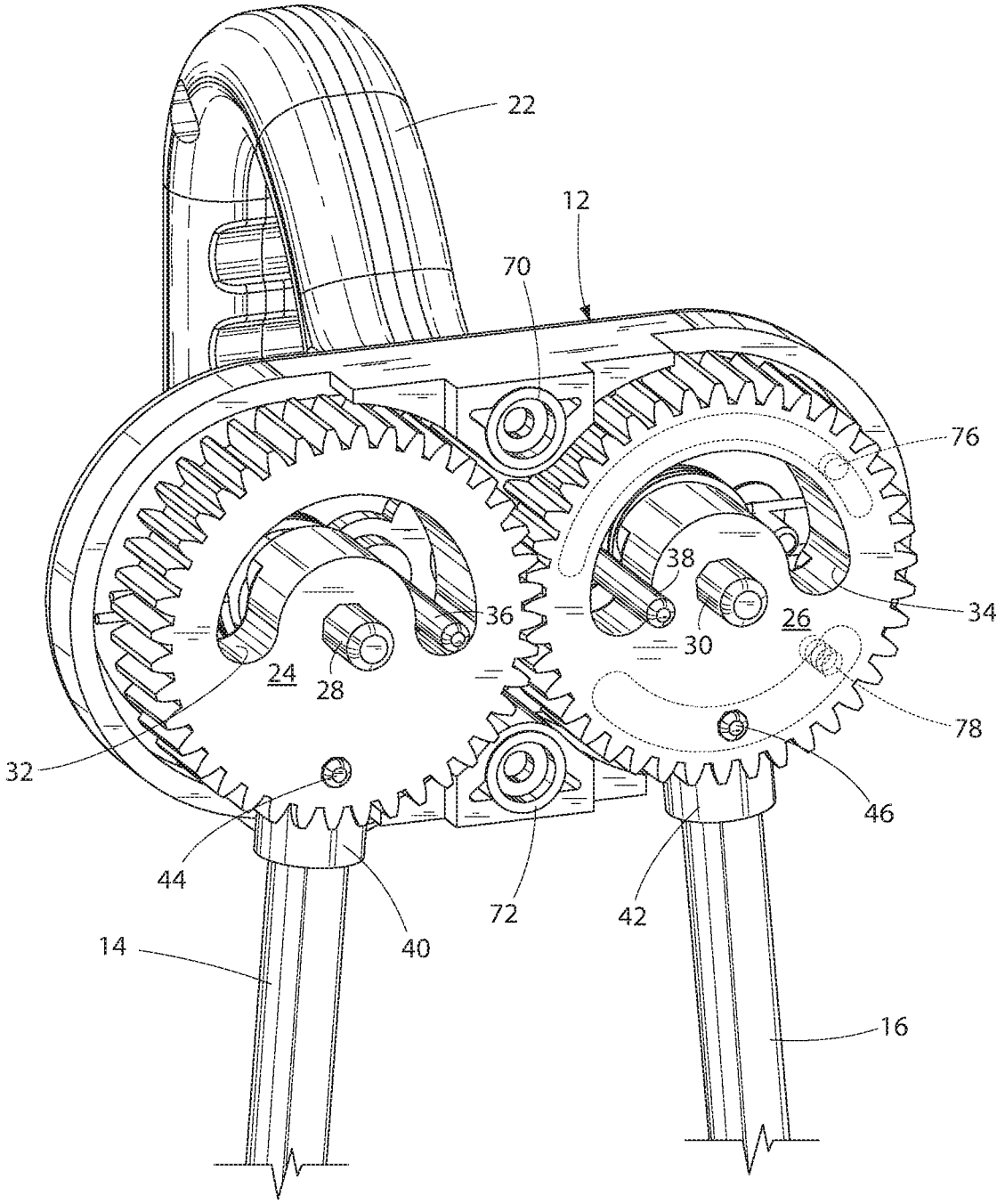
FIG. 4 is an enlarged perspective view of the housing, partially in phantom, particularly illustrating the interconnected motion of the two spheres and one embodiment of the means for illuminating the LED devices.
Figure 6:
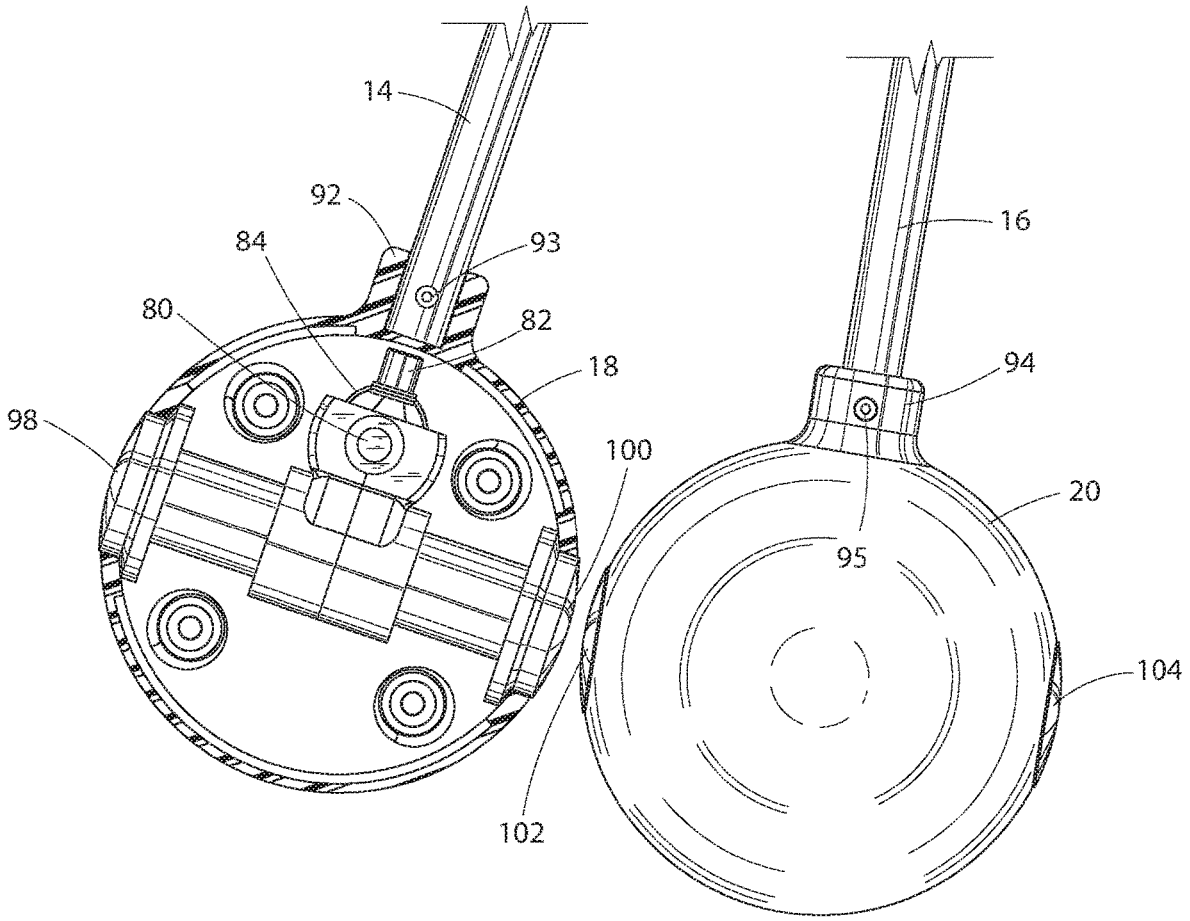
FIG. 6 is an enlarged perspective view, partially sectioned, of the spheres, illustrating an embodiment for illuminating the LED devices.

With reference made first to FIGS. 1-3, the embodiment of the clacker ball toy 10 illustrated therein has a housing 12. A plurality (i.e. two or more) of rods 14, 16 are connected to the housing 12 and will rotate in a circumferential arc relative to the housing 12. While two, generally cylindrical rods 14, 16 are illustrated, it should be understood that the number and geometry of rods 14, 16 is not considered a limitation on the instant disclosure, and additional rods in a variety of shapes and sizes are permissible. A sphere 18, 20 is mounted at the end of each rods 14, 16 at a location remote from the housing 12. The spheres 18, 20 each contain an LED illumination device that illuminates during use of the toy. As will be described in greater detail below, embodiments of circuit board 84 as illustrated in FIG. 6 may incorporate wireless connectivity, including (but not limited to) a Bluetooth™ interface to control illumination and audible functionality, such as changing sound and/or lighting patterns, enabling the possibility to change luminous LED colors and/or flashing LEDs. Is some embodiments, rods 14, 16 and/or spheres 18, 20 may be uncoated, or they may be coated with a paint comprising metallic subsidies to increase the resulting A/C output as will be described in further detail below.

Seen in FIG. 3, a handle 22 is attached to the housing for use in gripping the toy. The handle 22 is shown as a D-style handle, but any suitable shape may be used to advantage, for example rods or rings. The handle 22 may be affixed to the housing 12 in any conventional manner, including but not limited to adhesive(s), mechanical fasteners, and the like. Preferably handle 22 rotates for ergonomic adjustment and user comfort.

Rods 14, 16, as seen in FIGS. 1-5, are attached to a toothed gear 24, 26 disposed within the housing 12. Each of preferred toothed gears 24, 26 is connected to housing 12 by a pivot pin 28, 30 which may be formed integral with the housing 12 (for example, as an integrally molded boss projection) or may be a separate member. Accordingly, the toothed gears 24, 26 may rotate about the pivot pins 28, 30 within the housing 12. The teeth on the gears 24, 26 (see FIG. 4) are engaged with one another, and variations of size and spacing that permit this engagement are considered within the scope of the present invention. In this arrangement, as one of the gears rotates, it will cause a corresponding rotation in the other gear, but in an opposite direction. For example, if gear 24 rotates clockwise, it will cause gear 26 to rotate counter-clockwise. This, in turn, will ensure that the rods 14, 16 and spheres 18, 20 move in cooperative concert with one another.

The toothed gears 24, 26 have a curved opening or slot 32, 34 disposed above the pins 28, 30, respectively. A housing pin 36, 38 emanating from the housing 12 is located within the slot. As the gears 24, 26 rotate, the housing pins 36, 38 ride within the slots 32, 34 and function to limit the rotational movement of rods 14, 16 relative to the housing 12.

Figure 8:
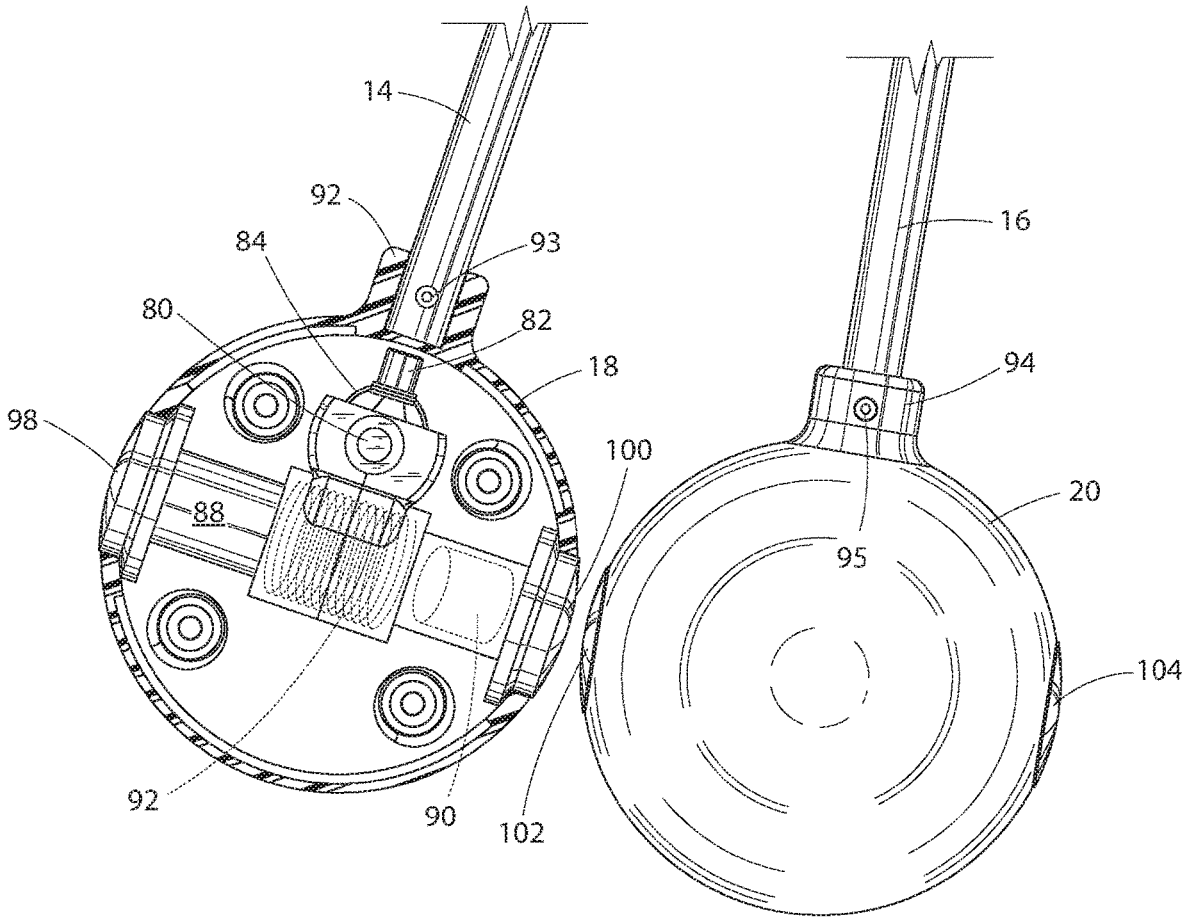
FIG. 8 is an enlarged perspective view, partially fragmented, of the spheres, illustrating an alternate embodiment for illuminating the LED devices.

Rods 14, 16 may be connected to the toothed gears 24, 26 in any suitable manner. In the embodiment shown, the toothed gears 24, 26 have a collar 40, 42 formed integral with the gear, but alternate embodiments may define said collar and gear species as separate components. The rod ends are positioned within the collars and affixed by a pin 44, 46. Rods 14, 16 are preferably circular in cross-section, but may be of any desired cross-sectional configuration or geometry. In some embodiments, the rods may be hollow or provide a suitable passageway to contain a wire for charging external devices or similar electrical connector to transmit electrical current to the LED elements contained in the spheres 18, 20, including (but not limited to) conductor 92 moving under the presence of magnetic field 90 and an electromagnetic field (EMF) is induced across the conductor as illustrated in FIG. 8.

Figure 5:
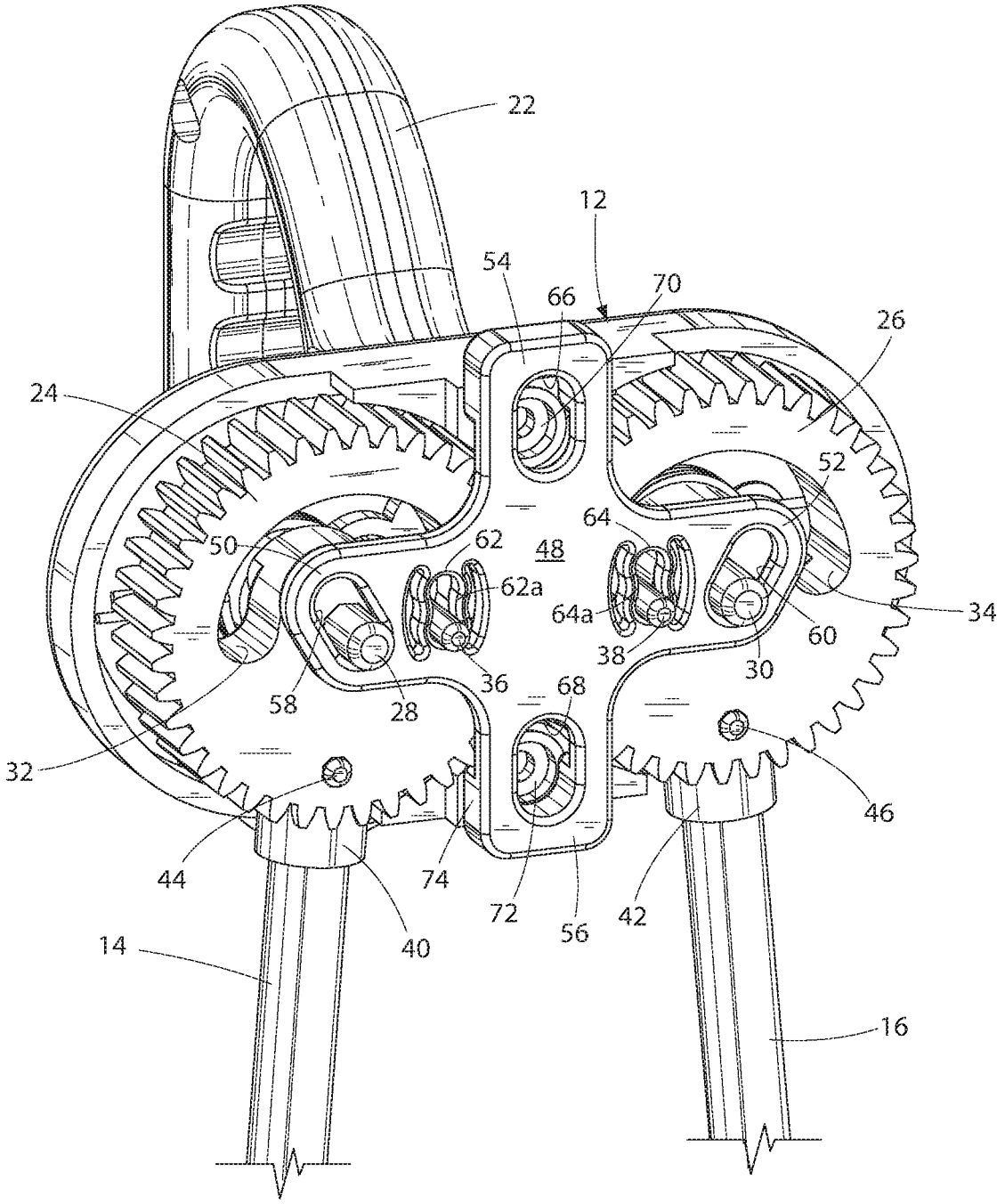
FIG. 5 is an enlarged perspective view of the housing, particularly illustrating a mechanism for locking the motion of the two spheres.

With reference to FIG. 5, a locking plate 48 is provided that cooperates with the toothed gears 24, 26 to secure the gears in place when the toy is positioned for operator training mode or not in use. The preferred training locking plate 48 has two horizontally opposed leg segments 50, 52 and two vertically opposed leg segments 54, 56. The horizontally opposed leg segments 50, 52 each may contain an oval shaped slot 58, 60 that is set on a bias relative to the vertical axis of the locking plate 48, the vertical axis being defined by the vertically opposed leg segments 54, 56. The slots 58, 60 are preferably sized to accommodate the pins 28, 30 therein. The horizontally opposed leg segments 50, 52 are also provided with a slotted aperture 62, 64 adapted to accommodate pins 36, 38, respectively. The slotted apertures 62, 64 are kidney shaped with a longitudinal axis aligned generally parallel with the vertical axis of the locking member 48. The kidney shape of the apertures 62, 64 provides a central area 62*a*, 64*a* that is narrower relative to other portions of the kidney shape, and approximately sized to the diameter of the pin 36, 38, but incidentally larger to allow the same to pass therethrough.

The opposed vertical leg segments may each contain an oval slot 66, 68 adapted to receive bossments 70, 72 of housing 12. The preferred bossments 70, 72 riding within the slots guide the locking member in an up-and-down motion. The rear face of the vertical leg segment 56 may contain a stop member 74. In training use, toy 10 is placed on a flat horizontal plane such as a table and the locking member 48 may be moved upwardly (in the view shown in FIG. 5) to engage the stop member 74 with the teeth of toothed gears 24, 26 (as shown in FIG. 5) thus synchronizing bi-rotational movement of the gears for operating training. The biased orientation of slots 58, 60 and the narrow central area 62*a*, 64*a* of slots 62, 64 provide a frictional resistance to maintain the locking member 48 in the synchronized locked condition. To release the gear, the locking member is merely moved downward with sufficient force to overcome the frictional resistance and disengage the stop member 74 to remove synchronization during use of the toy for improving the operator's motor skills. The frictional resistance provided by the central portions 62*a*, 64*a* of slots 62, 64 is sufficient to prevent the locking member 48 from being engaged unintentionally with the gears during use of the toy.

It will be apparent to those skilled in the art from the foregoing description that the spheres 18, 20 are able to move in a single fixed plane relative to housing 12. In the original clacker type toy, the balls were supported by a string. Thus, if the balls did not strike in perfect alignment, the balls could rebound in any direction. As a consequence, having bruised wrists and forearms was a common occurrence when playing with the toy. The design of the present invention prevents this injury potential by using rigid rods to restrict the motion of the spheres to a single plane and a defined circumferential pathway. This consistency also allows for use in the dark, where the LED elements can be used for increased entertainment.

With reference now being made to FIGS. 4, and 6-8, the various embodiments for illuminating the LED devices in the spheres 18, 20 will now be described. Magnetic induction is a phenomenon wherein electrical current is produced by moving a magnet field toward or away from a wire coil. The phenomenon was discovered in the 1830*s* and is widely known as Faraday's Law of Induction. This phenomenon can be applied in the present invention to generate current needed to illuminate an LED element when the toy is in use.

In a first embodiment as shown in FIG. 8, while only the interior components of sphere 18 are illustrated, it should be understood that the interior components of sphere 20 are identical thereto. As shown magnet 90 is positioned within housing 88 of sphere 18, preferably oriented with a south pole (positive or + pole) allowing a magnetic field to establish a repulsive effect on the opposing south pole (positive or + pole) of a magnet (not shown) contained within the opposing sphere 20, producing equivalent fields of energy inducing the repelling force on each sphere. The energy field generated at each sphere's 180° down rotation between grommets 100 and 102 and during the sphere's 180° up rotation between grommets 98 and 104 is representative of a field of magnetism where both magnets contacting each other are urged away from each other and forcing the respective magnets through respective cavities in housings 88 located in spheres 18, 20. Illustrated in FIG. 8, spheres 18 and 20 respective housings 88 are entwined with wires 92 to define individual wire coils. Magnet 90 is introduced through the center of housing 88 as shown in FIG. 8.

According to Faraday's Law, current is generated based on relative movement of the magnetic field and wire coil. Thus, either the magnet 76 or the wire coil 78 (FIG. 4) may be fixed in position while the other will move during use of the toy in their respective channels. For example, in one preferred embodiment, the magnet 76 is affixed to the toothed gear 26 and will move as the toothed gear 26 rotates. The wire coil 78 is fixed in position and may conveniently be affixed to the housing 12. As the toothed gear 26 rotates, the magnet 76 will move toward and away from the wire coil 78, depending on the direction of rotation. In another embodiment, the magnet may be in a fixed position while the wire coil moves with the rotation of the gear. While only one magnet and one wire are illustrated, it is understood that a second wire coil and magnet may be employed on the other toothed gear 24 and additional wire coil(s) and magnet(s) may be incorporated into the design to increase the amount of electrical current produced. In FIG. 8, housings 88, magnets 90, and wires 92 combine to create a conductive tube generator for producing electromagnetism into voltage or current flow during the movement of the relative kinetic energy of both magnets.

In FIG. 8 the wire coil 92 is fixed and may conveniently be affixed to housing 88. In FIG. 5 the bi-rotational toothed gears 24 and 25 preferably rotate clockwise and counter-clockwise in 180° arches, initiating the kinetic motion that respective spheres 18 and 20 require to produce energy and voltage. In FIG. 8 during each sphere's 180° kinetic motion both magnets are forced to move towards the center of each housing and respective wire coils. The location of the south pole of magnet 90 in sphere 18 oriented facing the south pole of the opposite magnet 90 contained in sphere 20 helps to reduce the impact of both spheres' grommets (respectively 100 to 102 and 98 to 104), increasing each magnet's velocity or kinetic energy, maximizing voltage as the magnets travel through wire coil 92 and housing 88 (also referred to as a conductive tube generator).

Figure 7:
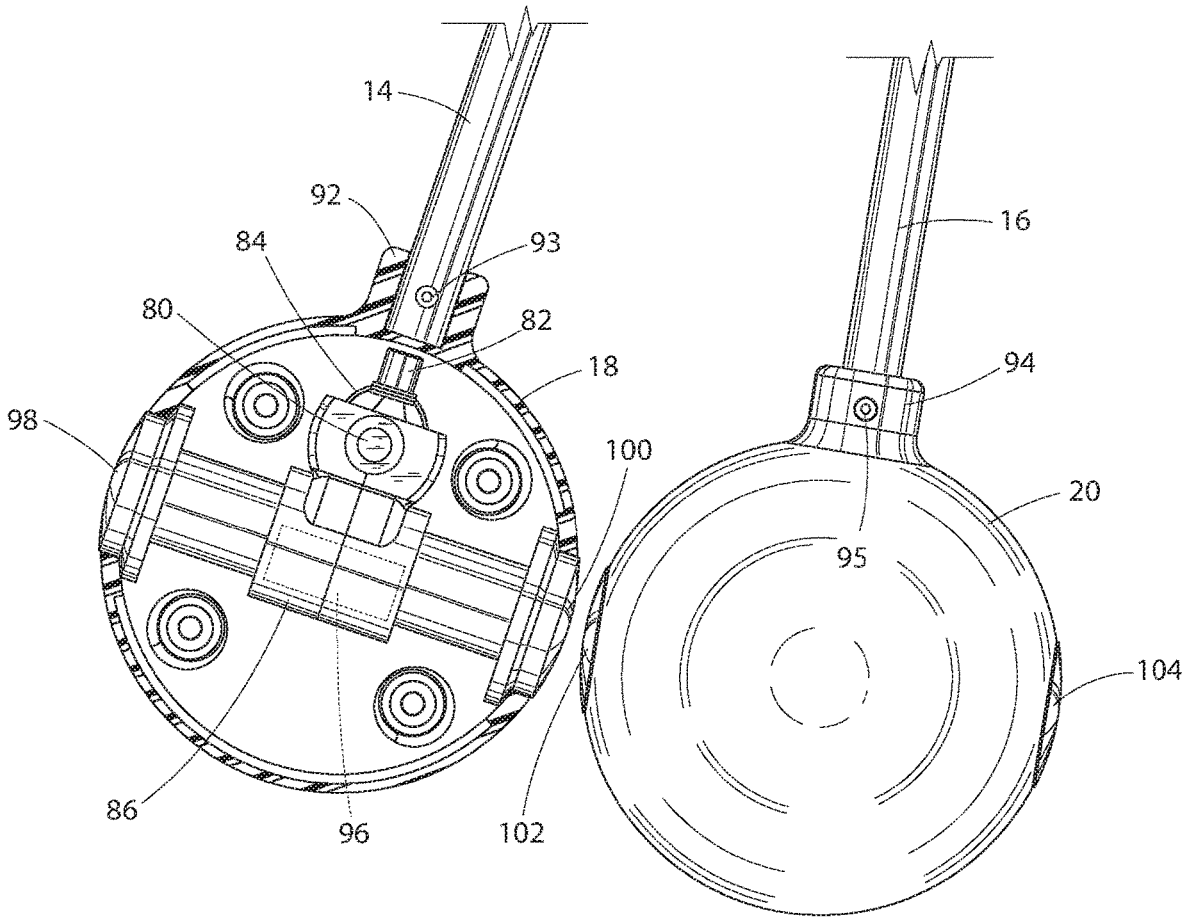
FIG. 7 is an enlarged perspective view, partially sectioned, of the spheres, illustrating an alternate embodiment for illuminating the LED devices.

Current produced by the relative movement between the magnet and wire coil is used to illuminate the LED device 80 located in the spheres as seen in FIGS. 6-8. Only one LED device 80 is shown, it being understood that multiple LED devices may be employed in each sphere and that sphere 20 may contain one of more LED devices as well. A transistor and a capacitor 84 are also located in the sphere 18 and comprise part of the electrical circuit. An electrical conductor, such as a wire (not shown), may be used to transmit the electrical current down the rod(s) 14, 16 to the spheres 18, 20.

In a second embodiment, shown in FIG. 7, the LED devices 80 are powered by the aforementioned electromagnetism, or in the alternative, a conventional battery powered circuit. The spheres 18, 20 contain the transistor, capacitor 84 and optionally a battery 96 contained within compartment 86. The type of battery used is not particularly critical, and can be a standard A, AA, or AAA size battery or a so-called button cell battery. Alternatively, one or more battery compartments 86 may be located within the handle 22 or the housing 12 or both. In FIG. 7, switch 82 is positioned horizontally to deactivate the LED consumption, turning the device off, but centripetal force or movement of the sphere turns the device on, and while in use actuates the illumination device. The switch may be a motion activated switch or may be manually operated and located, for example, on the handle 22 or housing 12. Although not shown, as would be understood another alternative power source such as photovoltaic (i.e. solar panel) could be utilized for charging toy 10 and powering LED devices 80. Additional variations are contemplated, such as the battery compartment may contain rechargeable batteries, such that energy created by the toy either when in use or by photovoltaic means can be stored in one or more rechargeable batteries and utilized to not only power the LEDs but also power external devices such as for example a cell phone. In an embodiment with solar charging, a portion of base 12 may serve as a front cover to house a solar panel.

In the embodiment of FIG. 8, magnetic induction is used to power the LED devices 80. The circuit comprises a transistor and capacitor 84 as in prior embodiments. A tubular member 88 contains a magnet 90 that can traverse from one side of the tubular member 88 to the other. A coil 92 is located in the general center of the tubular member 88. When the spheres are in motion, the magnet 90 will move from one end of tubular member 88 to the other, passing into and out of the coil 92, thus generating a current, which illuminates the LED device 80.

As shown in FIGS. 6-8, the spheres 18, 20 comprise generally hollow units and are most preferably made from a hard, but shatterproof and impact resistant material, thus providing safety as well as the distinctive "clack" sound when the spheres strike one another. The spheres 18, 20 have a collar portion 92, 94 to facilitate attachment of the rods 14, 16 to the spheres 18, 20, using pins 93, 95. If desired, the spheres 18, 20 may be provided with bumpers 98, 100, 102, 104 at the points where the spheres 18, 20 would impact one another when the toy is in use.

Other methods of illuminating the LED devices in the spheres may be employed. For example, one could harness the impact power of the balls striking one another to generate a piezoelectric current, which could then be used to illuminate the LED devices. This alternative embodiment would further include spheres 18, 20 formed from a material that would sufficiently deform upon impact to facilitate the piezoelectric effect. Similarly, the handle 22 is illustrated as a "D" style handle, although other handles shapes and configuration are within the scope of the invention.

The illustrations and examples provided herein are for explanatory purposes and are not intended to limit the scope of the appended claims.

I claim:

1. A toy, comprising a housing; a handle attached to the housing; a plurality of rods attached to the housing for rotational movement relative to the housing; a sphere attached to a remote end of each rod of the plurality of rods; an LED device located in at least one sphere; and a toothed gear connected to an opposite end of each rod of the plurality of rods, the toothed gears pivotally mounted within the housing, further comprising a locking member to releasably block the rotation of at least one of the toothed gears, the locking member comprising a locking plate having first, second, third, and fourth leg segments, the first and second leg segments each contain an opening that is set on a bias relative to a vertical axis of the locking plate, the vertical axis being defined by the third and fourth leg segments, said openings sized to accommodate one or more pivot pins that secure the toothed gears to the housing; wherein the first and second leg segments also define an aperture an aperture with a longitudinal axis aligned generally parallel with the vertical axis of the locking member, each of the apertures defining a central area that is narrower and approximate a size to a diameter of a housing pin positioned therein; and wherein the plurality of rods are operatively interconnected such the plurality of rods move in unison and in opposite rotational direction to one another; the spheres being capable of making contact with one another at two points in a common plane, said two points located above and below the housing.

2. The toy of claim 1, wherein the first and second leg segments are further defined as two horizontally opposed leg segments, wherein the third and fourth leg segments are further defined as two vertically opposed leg segments, wherein the openings are further defined as oval shaped slots, and wherein the apertures are further defined as kidney-shaped slotted apertures.

3. The toy of claim 1, wherein the locking member includes a detent to secure the locking member in a locked or unlocked position.

4. The toy of claim 1, further comprising a member providing electrical current to the LED device.

5. The toy of claim 1, further comprising a member providing electrical current to the LED device, wherein the member further comprises a battery, a transistor, and a capacitor.

6. The toy of claim 1, further comprising a member providing electrical current to the LED device, wherein the member further comprises a magnet and a wire coil.

7. The toy of claim 1, further comprising a member providing electrical current to the LED device, wherein the member further comprises a magnet and a wire coil, wherein the magnet is affixed to at least one of the toothed gears and the wire coil is affixed to the housing, and wherein upon rotation of the at least one toothed gear, the magnet will move into and out of the wire coil.

8. The toy of claim 1, further comprising a member providing electrical current to the LED device, wherein the member further comprises a magnet and a wire coil, wherein the at least one sphere containing the LED device further comprises a tubular member, said tubular member containing a movable magnet and a fixed wire coil, wherein upon movement of the sphere, the magnet will move through the tubular member and pass into and out of the wire coil.

9. The toy of claim 1, wherein the spheres are provided with bumpers at points where the spheres make contact with one another.

* * * * *